US007597656B2

(12) United States Patent
Trees

(10) Patent No.: US 7,597,656 B2
(45) Date of Patent: Oct. 6, 2009

(54) THERAPEUTIC EXERCISE DEVICE

(75) Inventor: Darin Trees, Dickinson, TX (US)

(73) Assignee: Encore Medical Asset Corporation, Henderson, NV (US)

( * ) Notice: Subject to any disclaimer, the term of this patent is extended or adjusted under 35 U.S.C. 154(b) by 1074 days.

(21) Appl. No.: 10/695,117

(22) Filed: Oct. 28, 2003

(65) Prior Publication Data

US 2006/0293156 A1 Dec. 28, 2006

Related U.S. Application Data

(60) Provisional application No. 60/422,016, filed on Oct. 29, 2002.

(51) Int. Cl.
*A63B 26/00* (2006.01)

(52) U.S. Cl. ..... 482/142

(58) Field of Classification Search ..... 482/144–145, 482/142; 601/1, 32, 23–24, 5; 5/610, 613, 5/618, 621, 624, 602, 600, 614
See application file for complete search history.

(56) References Cited

U.S. PATENT DOCUMENTS

| | | | | | |
|---|---|---|---|---|---|
| 238,799 | A | * | 3/1881 | Morgan | 5/619 |
| 1,018,757 | A | * | 2/1912 | Grady | 5/618 |
| 1,735,569 | A | * | 11/1929 | Emery | 606/243 |
| 2,598,204 | A | * | 5/1952 | Allen | 601/35 |
| 2,768,622 | A | * | 10/1956 | Sanders | 606/242 |
| 3,527,202 | A | * | 9/1970 | Donzelle | 600/21 |
| 3,589,358 | A | | 6/1971 | Megal | |
| 3,741,200 | A | | 6/1973 | Morin | |
| 3,759,252 | A | * | 9/1973 | Berman | 602/19 |
| 3,821,953 | A | * | 7/1974 | Mikan | 606/245 |
| 4,113,250 | A | | 9/1978 | Davis | |
| 4,378,791 | A | * | 4/1983 | Sarrell | 602/32 |
| 4,383,684 | A | | 5/1983 | Schliep | |
| 4,444,178 | A | * | 4/1984 | Kuo | 482/144 |
| 4,638,793 | A | * | 1/1987 | Therkorn | 606/243 |
| 4,672,697 | A | | 6/1987 | Schurch | |
| 4,825,852 | A | * | 5/1989 | Genovese et al. | 601/34 |
| 4,867,143 | A | | 9/1989 | Morin | |
| 4,890,604 | A | * | 1/1990 | Nelson | 602/32 |
| 4,913,424 | A | | 4/1990 | Pepin | |
| 4,995,378 | A | * | 2/1991 | Dyer et al. | 606/241 |
| 5,024,214 | A | | 6/1991 | Hayes | |
| 5,125,884 | A | * | 6/1992 | Weber et al. | 482/145 |
| 5,169,363 | A | | 12/1992 | Campanaro et al. | |
| 5,263,913 | A | | 11/1993 | Boren | |
| 5,402,544 | A | * | 4/1995 | Crawford et al. | 5/616 |
| 5,413,543 | A | * | 5/1995 | Drago | 482/49 |
| 5,551,937 | A | | 9/1996 | Kwo | |

(Continued)

*Primary Examiner*—Lori Amerson
(74) *Attorney, Agent, or Firm*—Ropes & Gray LLP

(57) ABSTRACT

A therapeutic exercise device which may be used both as a tilt table and as an exercise device includes a base and a support frame that is pivotally mounted on the base. The support frame has a lower end and an upper end. A carriage is mounted for sliding movement along at least a portion of the support frame. The carriage includes a lower section and an upper section that is pivotally attached to the lower section. The device also includes a left foot rest and a right foot rest, each of which is independently pivotally attached to the lower end of the support frame. A body-restraining belt is also provided to secure the body of a patient to the carriage.

19 Claims, 14 Drawing Sheets

U.S. PATENT DOCUMENTS 5,601,519 A * 2/1997 Comereski ..... 482/142
5,810,698 A * 9/1998 Hullett et al. ..... 482/96
5,885,197 A 3/1999 Barton
5,938,571 A 8/1999 Stevens
5,940,911 A * 8/1999 Wang ..... 5/610
5,967,956 A 10/1999 Teeter
6,243,897 B1 6/2001 Sumiya
6,446,287 B2 * 9/2002 Borders ..... 5/618
6,464,296 B1 10/2002 Sumner
6,645,130 B2 * 11/2003 Webber ..... 482/142
7,181,793 B2 * 2/2007 Lee ..... 5/610
2004/0043876 A1 * 3/2004 Craciunescu ..... 482/114

* cited by examiner

THERAPEUTIC EXERCISE DEVICE

CROSS REFERENCE TO RELATED APPLICATION

This application claims the benefit of U.S. Provisional Application No. 60/422,016 which was filed on Oct. 29, 2002.

FIELD OF THE INVENTION

The invention relates to a physical therapy table useful primarily in the rehabilitation of patients with severe muscle weakness and the inability to support full body weight in standing.

BACKGROUND OF THE INVENTION

Recent medical advances have allowed more patients to survive serious injuries or disease processes than ever before. Unfortunately, the period of bed rest required for recovery may lead to severe deterioration of muscle strength and the inability to support full body weight in standing. It is challenging for rehabilitation specialists to help these patients regain the ability to stand and begin ambulation. The challenge is especially great for obese patients. A common technique in current practice is to summon as many colleagues as practical to lift and maneuver the weakened patient to a standing position while he or she attempts to bear full weight through the lower extremities. This technique is not only dangerous, because of the risk of a fall, but it is also psychologically degrading for the patient as the activity reinforces the patient's dependence on others.

An alternative to mobilizing deconditioned patients with manpower is to use a tilt table. A tilt table resembles a stretcher having a top section that can be tilted gradually from a horizontal to a vertical position. The patient is transferred laterally from the hospital bed to the tilt table surface and secured to the table with straps placed across the knees and waist. The table's surface is then tilted to the desired inclination. A footboard at the lower end prevents the patient from sliding off the table and allows graded weight-bearing through the legs. The benefits of tilt table standing include a gradual retraining of the cardiovascular system to the demands of the body's upright position and the re-education of the balance mechanisms affected by long periods of bed rest.

Unfortunately, tilt tables have a significant limitation. The tilt table is only able to bring the patient to an upright position while simultaneously restricting movement of the lower extremities. This restriction prevents movement through the range-of-motion of the knee joints and greatly limits strengthening of the lower extremity musculature, because the legs are strapped to the table. The conventional tilt table design has no mechanism to enable a patient to perform lower or upper extremity exercise for strengthening or conditioning.

Exercise machines with a movable sled on inclined rails, which the user moves against the resistance of his body weight, are well known. Such devices are described in U.S. Pat. No. 4,383,684 of Schliep, U.S. Pat. No. 5,169,363 of Campanaro, U.S. Pat. No. 5,263,913 of Boren and U.S. Pat. No. 5,938,571 of Stevens. These pieces of equipment permit a user to exercise by using his legs or arms to move a moveable sled on which his body is supported on an inclined platform or set of rails. The inclination of the platform or rails on which the sled is moved may be changed to vary the resistance offered by the user's body weight. Such devices are designed for healthy users who are able access the apparatus from a standing position. In fact, the user must get on and off these devices in order to change the inclination or resistance level of the exercise device. Furthermore, these devices are made for simultaneous bilateral lower extremity exercise and may not be suitable for use by users that are unable to stand due to weakness or by users with one lower extremity that is non-weight bearing, such as a fractured or amputated leg.

U.S. Pat. No. 5,885,197 of Barton discloses an exercise apparatus with a stationary base on which is mounted a pivoting frame having a movable sled thereon. The apparatus includes a motor-drive for changing the angle of inclination of the pivoting frame. Although users are able to remain on the apparatus while the incline is changed, it is not safe for patients with severe deconditioning. Furthermore, there is no means of locking the sled in place while a user mounts the machine and no means of adjusting the sled travel. If a patient's knees were to buckle, the sled would slide down the rails and could injure the patient. In addition, a patient with severe weakness would be unable to keep his feet on the platform, as there is no means of supporting the legs or securing the feet to the platform. The carriage of the Barton patent, like that of the Boren patent, includes shoulder rests to allow a user to push the carriage up the inclined frame with his legs. These shoulder rests would prevent a lateral transfer of a user to the sled from a patient's bed. The only way to mount the device would be to sit on the carriage and slowly lower down between the rests. The Barton device also includes hand grips mounted on the guide rails for upper extremity workouts. However, since these grips are fixed in place, they would prevent a lateral transfer of a user onto the apparatus from a patient's bed.

Traction tables, in which a force is applied to effect spinal traction, are also well known. U.S. Pat. No. 3,741,200 of Morin describes a tilting table with multiple sections that can be locked and released so as to move with respect to each other on the table frame. By locking some sections together and permitting this joined subassembly to slide on the frame with respect to other sections, spinal traction may be produced on a patient on the table by the action of gravity. A traction device which does not include a tilting feature is described in U.S. Pat. No. 5,024,214 of Hayes. Inversion tables, which invert to produce spinal traction, are described in U.S. Pat. No. 4,867,143 of Morin, U.S. Pat. No. 5,551,937 of Kwo and U.S. Pat. No. 5,967,956 of Teeter. Motorized versions of the traction table are described in U.S. Pat. No. 4,113,250 of Davis and U.S. Pat. No. 4,672,697 of Schürch. These tables are designed to treat back and neck ailments by inverting a patient who is secured to a platform to a head-down position. Such tables would not be used for the treatment of muscular weakness and would be unsafe to use on the population of patients with severe deconditioning. Tilting such patients to a head-down position could lead to respiratory distress, increased blood pressure and increased intracranial pressure, all of which are potentially harmful to the patients.

Lastly, with exception of the traditional tilt table, all of the other devices described above are not designed for easy transportability, especially for movement into and out of hospital rooms and intensive care units. It would be desirable if a table was mobile to allow transport to hospital rooms and could function as a tilt table and an exercise apparatus. It would also be desirable for the table to accommodate patients with a non-weight bearing restriction such as a fractured or amputated leg and for the head of the patient supporting carriage to elevate allowing improved respiration for patients.

ADVANTAGES OF THE INVENTION

Among the advantages of the invention is that it functions both as a passive tilt table and as a strengthening apparatus for patients with severe muscle weakness and/or the inability to stand without assistance. Another advantage of the invention is that it uses resistance against the patient's body weight to increase strength, range of motion, and conditioning for deconditioned patients. Still another advantage of a preferred embodiment of the invention is that it facilitates upper extremity exercise. Yet another advantage of a preferred embodiment of the invention is that it facilitates easy transfer of a patient to and from a hospital bed.

Additional advantages of this invention will become apparent from an examination of the drawings and the ensuing description.

SUMMARY OF THE INVENTION

The invention comprises a therapeutic exercise device which includes a base and a support frame that is pivotally mounted on the base, said support frame having a lower end and an upper end. A carriage is mounted for sliding movement along at least a portion of the support frame, said carriage comprising a lower section and an upper section that is pivotally attached to the lower section. The device also includes a left foot rest and a right foot rest, each of which is independently pivotally attached to the lower end of the support frame, and a body-restraining belt that is adapted to secure the body of a patient to the carriage.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

EXPLANATION OF TECHNICAL TERMS

Figure 1:
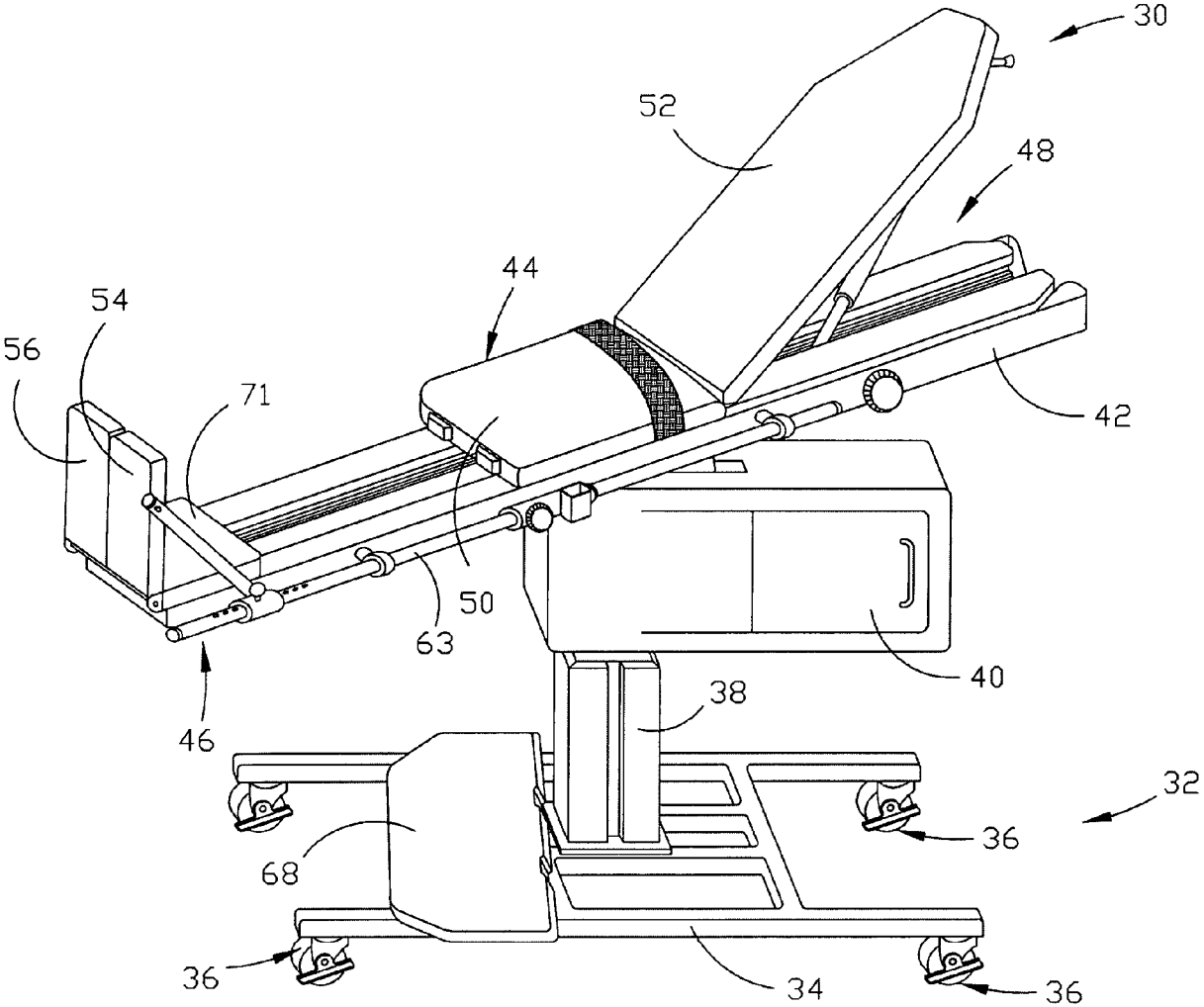
FIG. 1 shows a perspective view of a preferred embodiment of the therapeutic exercise device of the invention.
Figure 2:
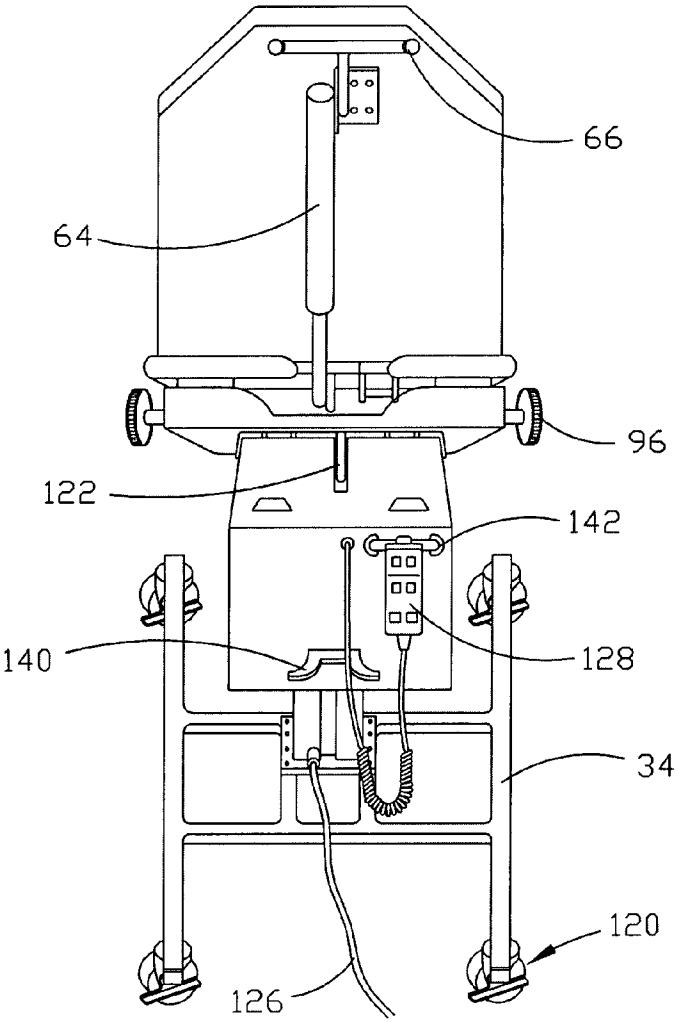
FIG. 2 is a rear view of the embodiment of FIG. 1.
Figure 3:
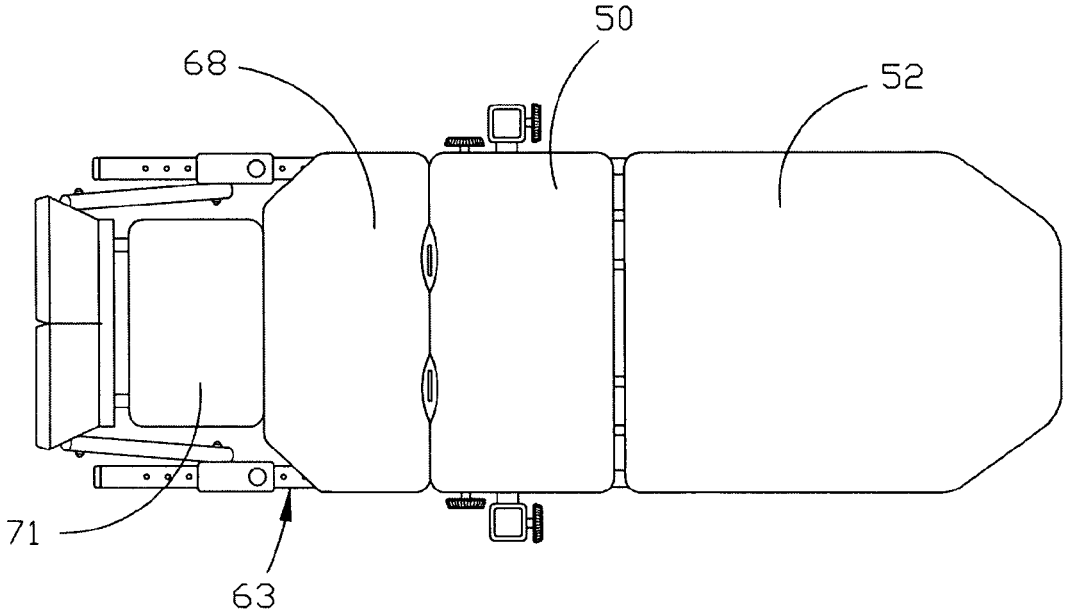
FIG. 3 is a top view of the embodiment of FIGS. 1 and 2, with the support frame shown in a generally horizontal attitude and the center section attached to the support frame.
Figure 4:
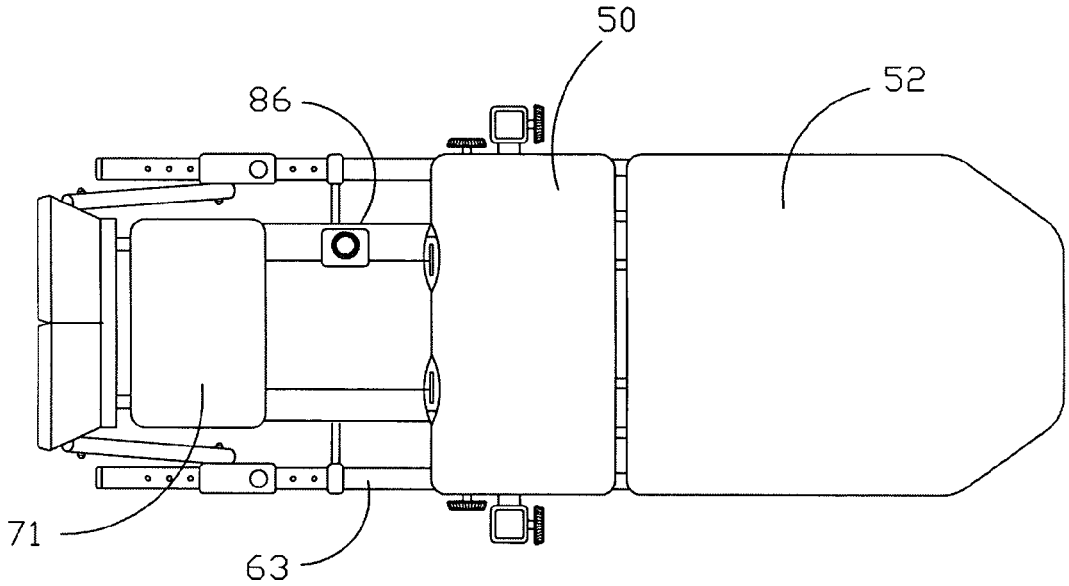
FIG. 4 is a top view of the embodiment of FIG. 3, with the center section removed.
Figure 5:
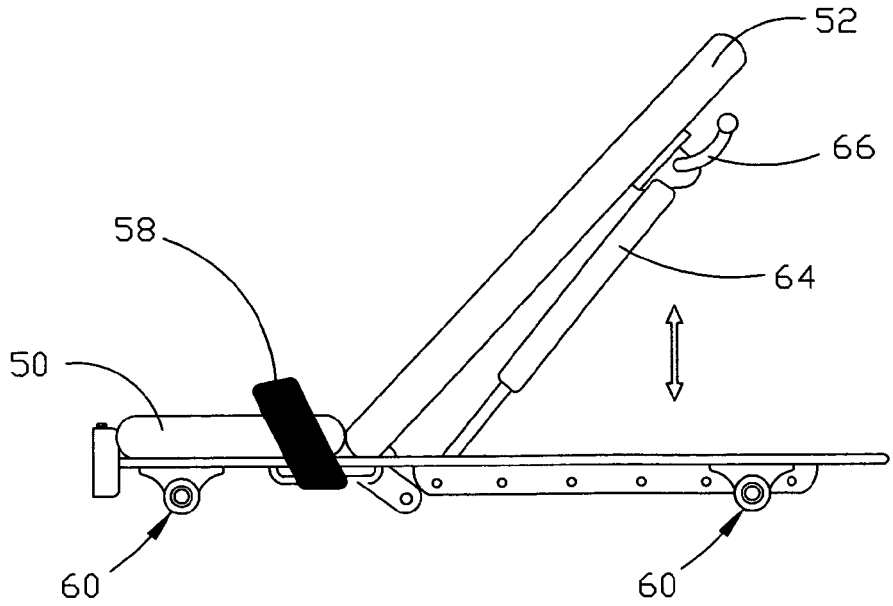
FIG. 5 is a side view of the carriage of the preferred embodiment of FIGS. 1-4.

As used herein, the term "deconditioned" and similar terms refer to a condition of a person who, due to injury, disease or other circumstance, is in a weakened state. Such persons may suffer from lower extremity paralysis or an altered mental state, and may be unable to support their body weight in a standing position.

DESCRIPTION OF THE PREFERRED EMBODIMENTS

As shown in FIGS. 1-6, preferred therapeutic exercise device 30 includes base 32 having base frame 34, wheels 36, support column 38 and storage compartment 40. Support frame 42 is pivotally mounted on the base, and carriage 44 is mounted for sliding movement along at least a portion of the support frame. Support frame 42 has a lower end 46 and an upper end 48. Carriage 44 includes lower section 50 and upper section 52 that is pivotally attached to the lower section. Device 30 also includes left foot rest 54 and right foot rest 56, each of which is independently pivotally attached to the lower end of the support frame. A first body restraining belt 58 is provided to secure the body of a patient to the carriage.

Figure 14:
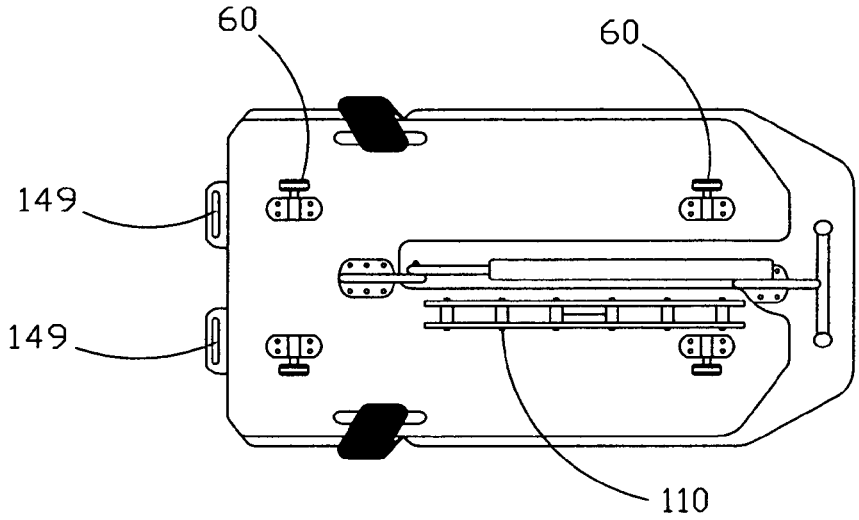
FIG. 14 is a bottom view of the carriage of a preferred embodiment of the therapeutic exercise device.

Carriage 44 preferably includes four friction-free bearing wheels 60 (shown in FIGS. 5, 14 and 19) that track in guide rails 62 (see FIGS. 15 and 19) of support frame 42. Adjustment rails 63 are attached on the outer sides of support frame 42. As shown in FIGS. 1-6, upper section 52 of carriage 44 can be positioned from a surface that is generally parallel to the plane of the support frame to a 45° incline with a first tilt mechanism such as power-assisted gas spring 64. To incline the upper section, a lever 66 at the top of the section is pulled upwards. The upper section may be locked in place in a manner known to those having ordinary skill in the art to which the invention relates when the lever is released.

Figure 11:
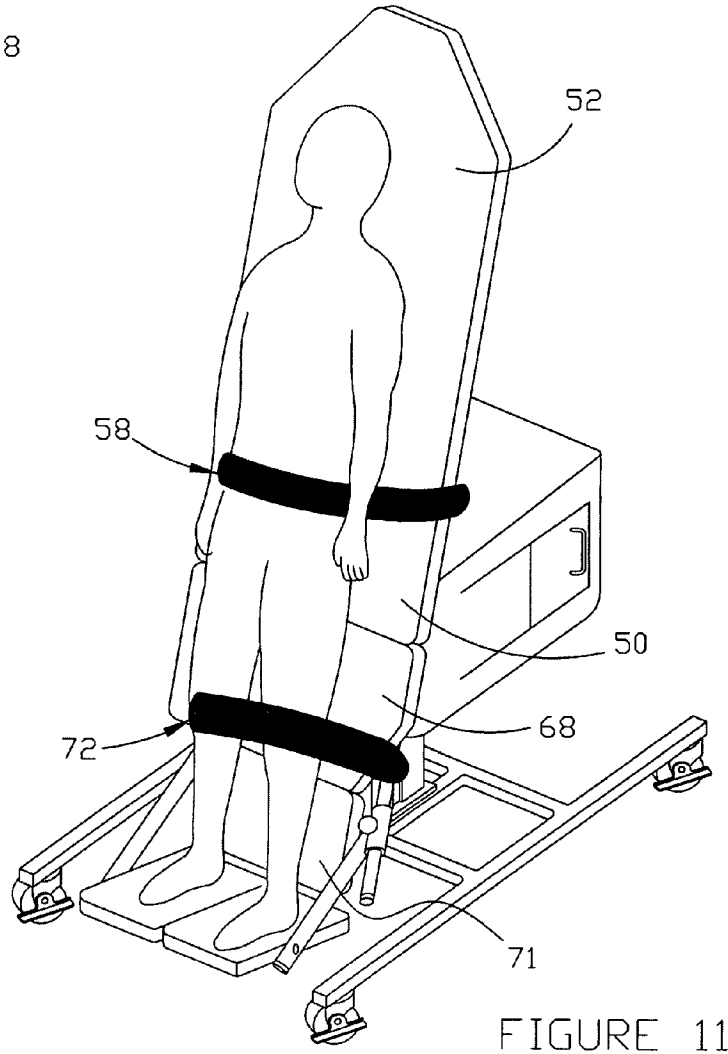
FIG. 11 is a perspective view of a preferred embodiment of the therapeutic exercise device, showing use of the device in its tilt table configuration by a patient.
Figure 12:
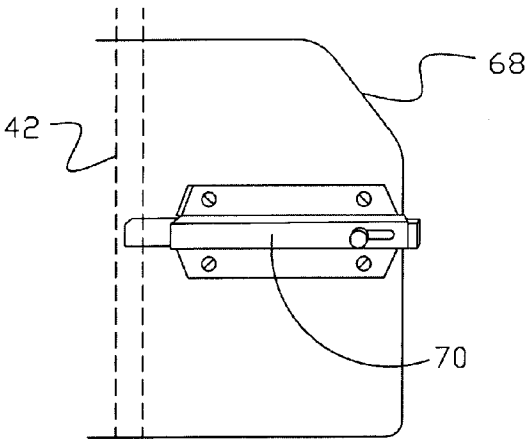
FIG. 12 is a front view of a preferred mechanism for locking the center section of the therapeutic exercise device to the support frame.

In a preferred embodiment of the invention, center section 68 is employed to provide a flat table surface when the device is used as a tilt table (see FIG. 11). As shown in FIG. 12, sliding lock 70, located on the underside of the center section, is used to secure the section onto support frame 42. Preferably, device 30 also includes ankle support pad 71, which is attached to lower end 46 of the support frame near the foot rests and serves to support the legs during exercise.

It is preferred that the center section be sized and arranged so that when it is secured to the support frame, the carriage is prevented from sliding thereon. A second body-restraining belt such as knee strap 72 (see FIGS. 6 and 11) is provided for use when the device is configured in the tilt table mode. The knee strap attaches to both adjustment rails 63 and serves to prevent the patient's knees from bending. As shown in FIG. 1, center section 68 may be stored on the base when not in use.

Figure 6:
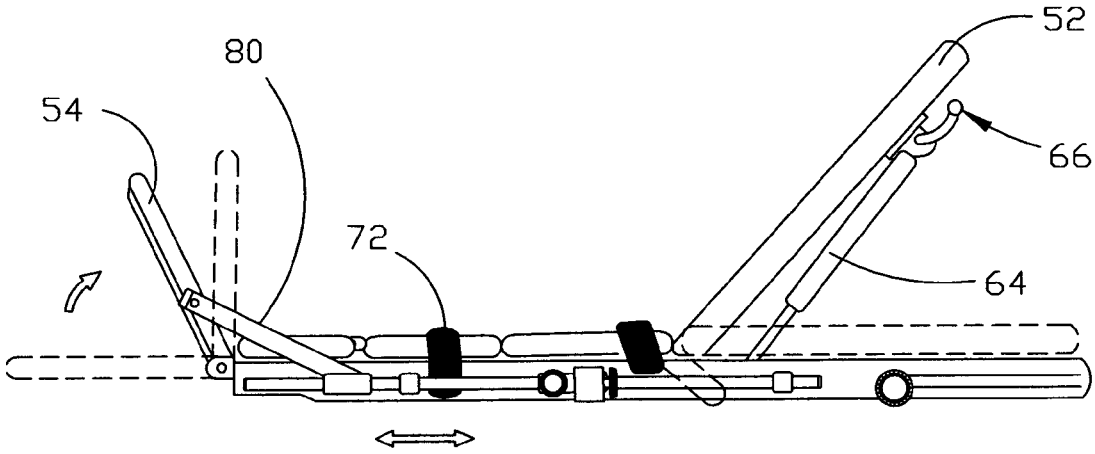
FIG. 6 is a side view of the carriage and support frame of the preferred embodiment of FIGS. 1-5.
Figures 7, 8:
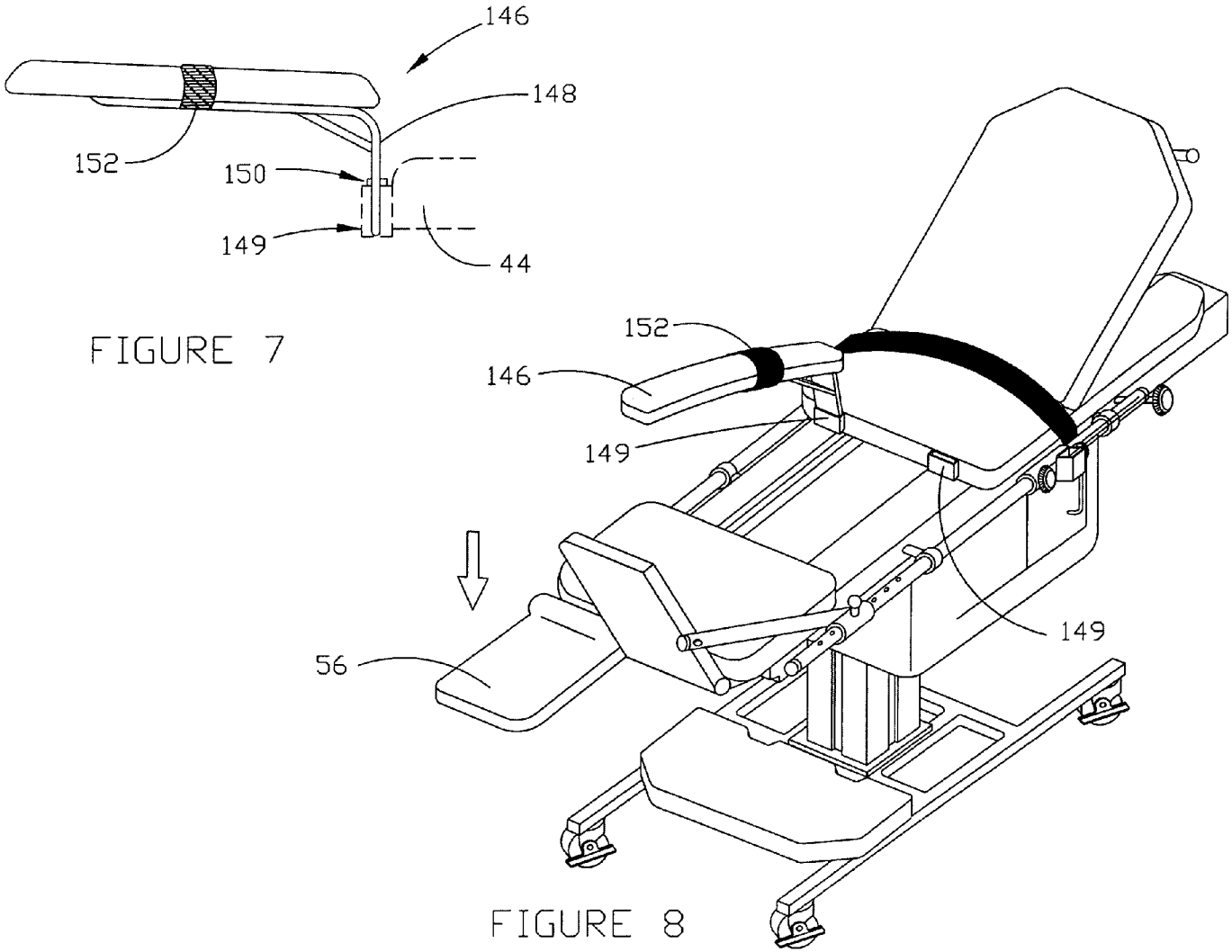
FIG. 7 is a side view of an upper leg support that is a part of a preferred embodiment of the invention.
FIG. 8 is a perspective view of a preferred embodiment of the therapeutic exercise device with the upper leg support in place for use.
Figure 20:
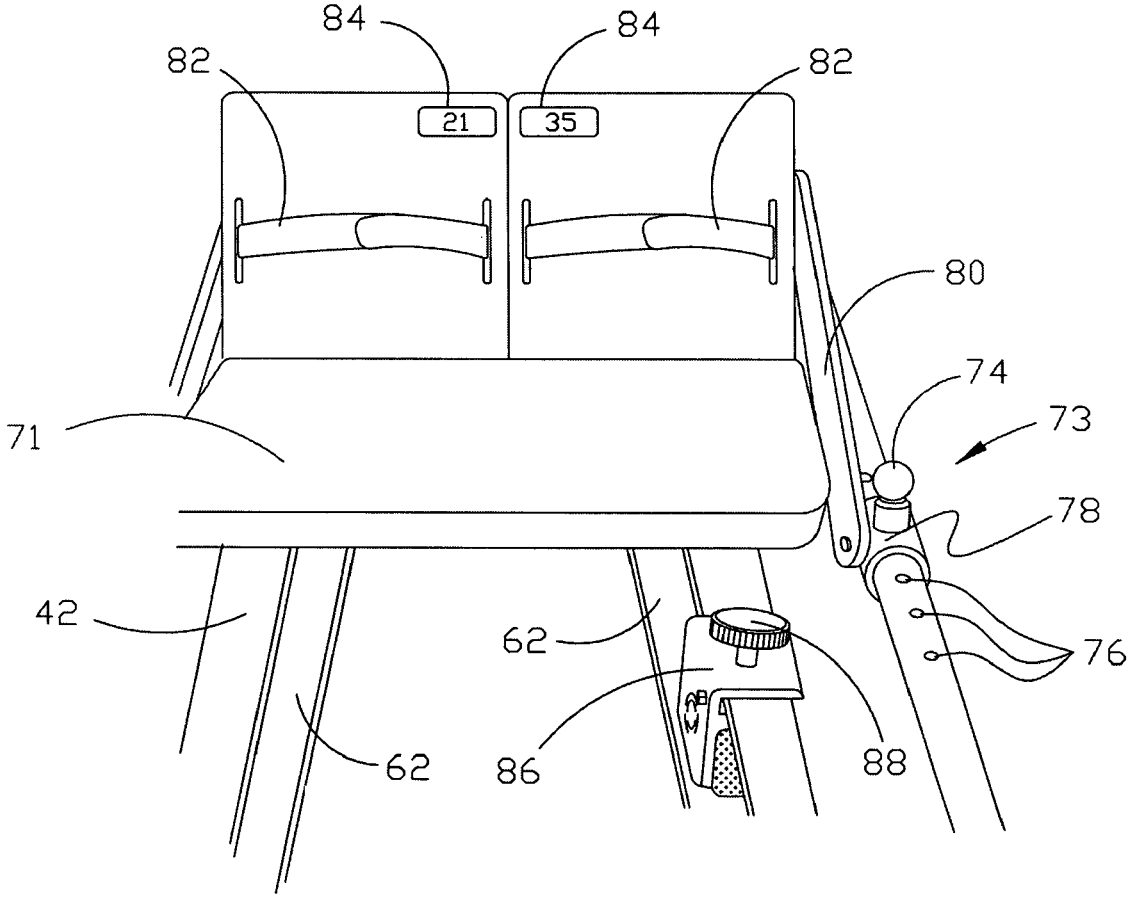
FIG. 20 is a perspective view of the foot rests of a preferred embodiment of the therapeutic exercise device, showing force-measuring mechanisms and digital readouts for displaying the forces that are applied to the foot rests during exercise.

Adjustable foot rests 54 and 56, located at the lower end of the support frame, can be positioned in an angled position with respect to the plane of the support frame by adjusting a spring lock 73 (best shown in FIG. 20) which is provided for each foot rest (although only one is shown in FIG. 20). The spring lock is mounted on adjustment rail 63 and includes a conventional spring-loaded pin 74 which will fit within any of a series of holes 76 located on the adjustment rail. The spring lock is located on a fixation bracket 78 that is connected to the foot rest with a stabilizer 80. As shown in FIG. 6, the foot rests are adapted to be independently pivoted between an angle of 0° with respect to the support frame (at which angle the foot rest is generally parallel to and coplanar with the ankle support pad) when exercise for one leg only is desired, and an angle of about 90° when exercise for both legs is desired. A pair of restraining belts such as foot straps 82 (see FIG. 20) are provided to secure the feet of the patient on each of the foot rests and prevent the feet so secured from rotating laterally.

It is also within the scope of this invention for the foot rests to have a force measuring mechanism such as a conventional load cell (not shown) mounted therein. Preferably, the foot rests will also be provided with a built-in digital displays 84 that are electrically attached to the load cells to display the amount of force applied to each foot rest (and thereby show the amount of his weight that the patient is supporting with his feet). This feature allows therapists to objectively measure the patient's daily progress. The force measuring mechanisms may also be used to re-educate the patient to distribute weight equally through both legs while standing.

Figure 19:
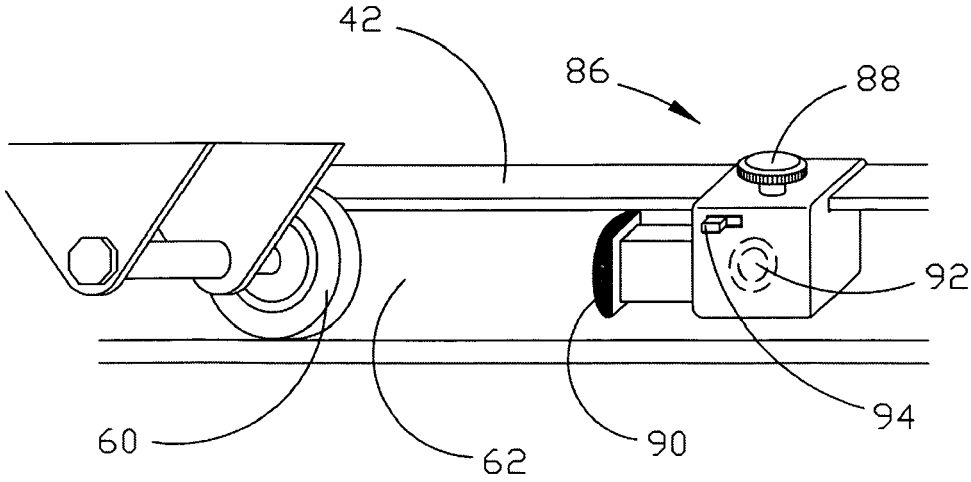
FIG. 19 is a perspective view of a portion of the carriage and support frame of a preferred embodiment of the therapeutic exercise device, showing a signaling mechanism for use in monitoring the progress of a patient when exercising.

In a preferred embodiment of the invention, a range of motion (ROM) stop 86 is adapted to be adjustably mounted on one side of the support frame so as to limit the sliding motion of the carriage at a plurality of locations on the support frame. Preferably, ROM stop 86 is adapted to slide along the support frame and is provided with a locking bolt 88 that can be turned down to lock the stop on the support frame at a desired location when the device is in the exercise mode. As shown in FIG. 19, it is also preferred that the ROM stop include a limit detector or sensor 90 that determines when the carriage has moved to the position of the ROM stop. Preferably, the limit detector will activate a signaling mechanism such as audible alarm or chime 92. The alarm may be provided with a switch 94, so that the alarm can be turned on or off as desired. As a patient moves the carriage downwards during the squat exercise, carriage wheel 60 will contact the sensor and give an auditory feedback, such as a chime, indicating one successful repetition of the exercise. If stretching is desired, the alarm device may include a timer and be programmed to chime at a predetermined rate (such as once each second). This gives the patient an indication of how long to hold the sustained stretch. For example, if a therapist would like the patient to hold the squat position for 5 seconds and if the alarm is programmed to chime at a rate of once per second, the alarm would chime 5 times before the patient was to push back to straighten his knees.

Figure 15:
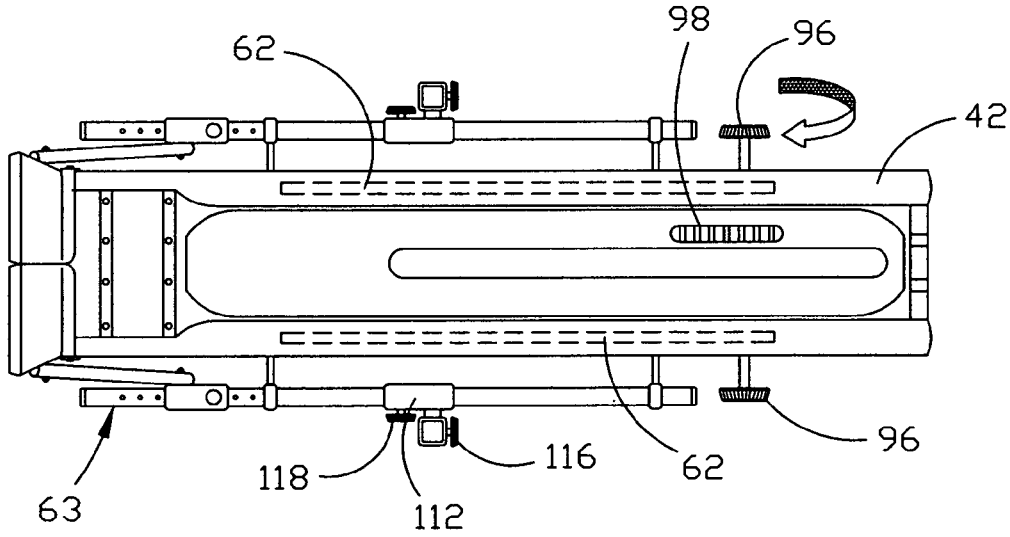
FIG. 15 is a top view of the support frame of a preferred embodiment of the therapeutic exercise device.
Figure 21:
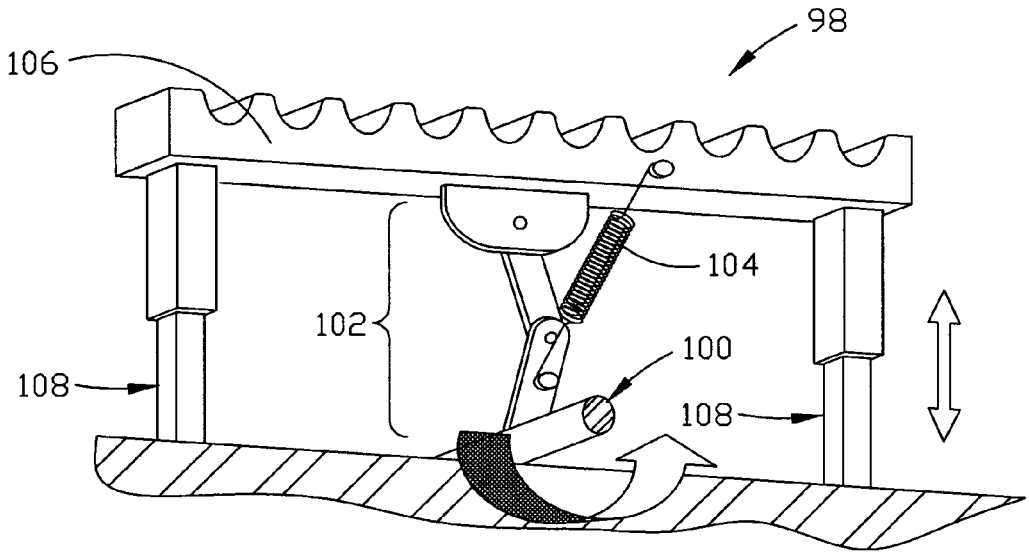
FIG. 21 is a perspective view of a portion of a preferred locking assembly for locking the carriage with respect to the support frame, showing the lock engaged.
Figure 22:
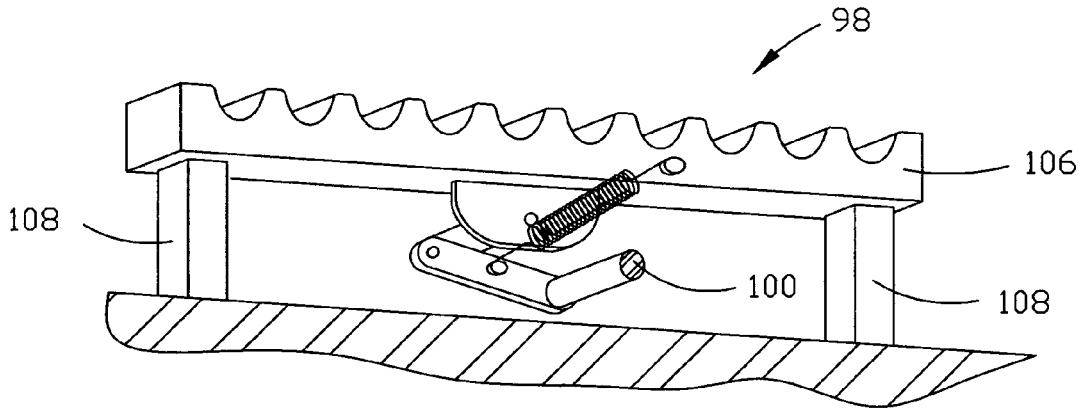
FIG. 22 is a perspective view of the portion of the preferred locking assembly of FIG. 21, showing the lock disengaged.

In a preferred embodiment of the invention, handles 96, located on either side of the support frame, are attached to a grooved locking assembly 98 (shown in FIGS. 15, 21 and 22). As shown in FIGS. 21 and 22, locking assembly 98 includes rod 100 (to which a handle 96 is attached), link mechanism 102, spring 104 and engagement device 106, which is mounted on support rods 108. When a handle 96 is turned clockwise (as shown in FIG. 21), the engagement device elevates and latches onto a one of a series of bolts 110 (see FIG. 14) located on the underside of the carriage, which locks the carriage with respect to the support frame (see FIG. 21). When unlocked (as shown in FIG. 22), the carriage is free to slide along the frame, allowing the patient to perform a squat exercise.

Figure 9:
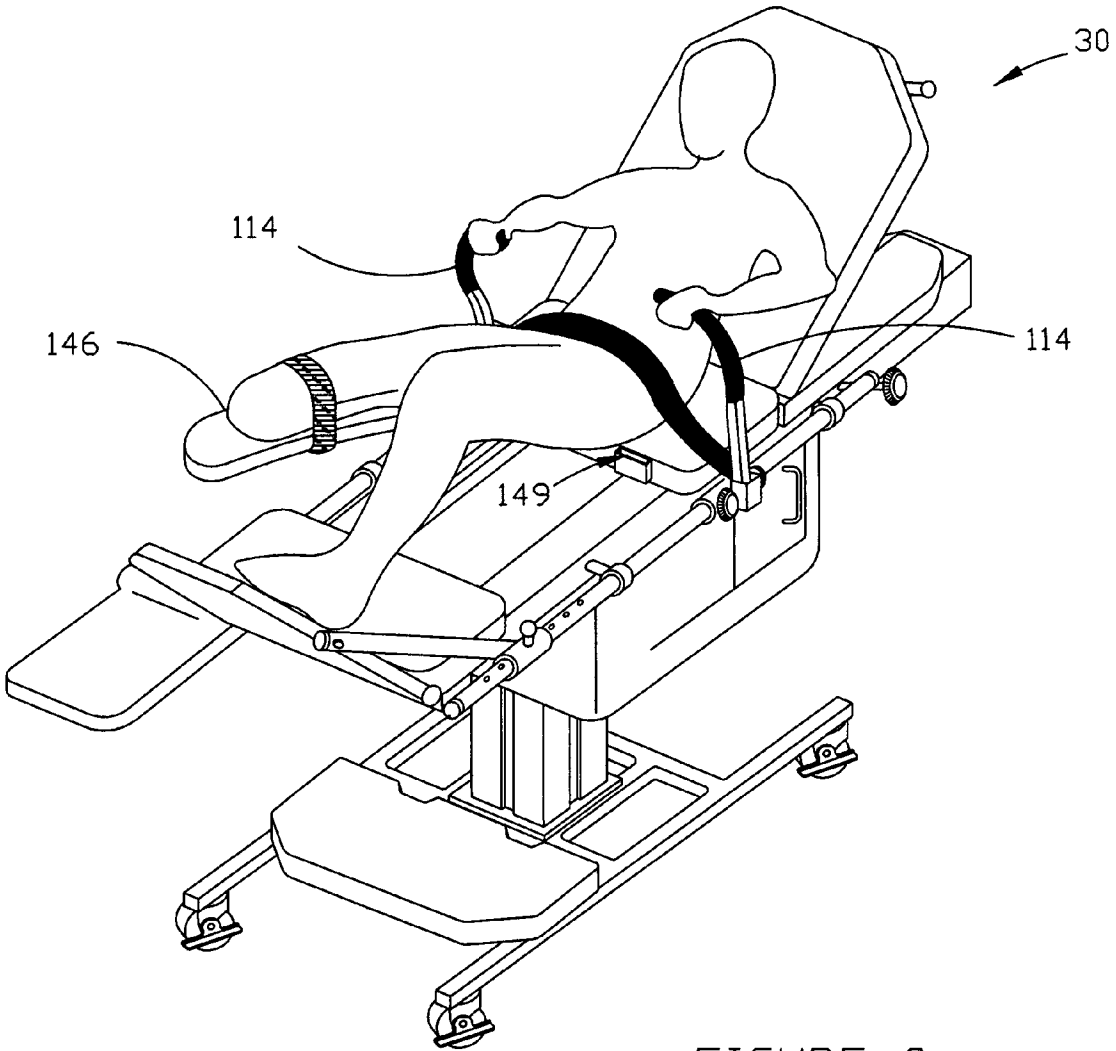
FIG. 9 is a perspective view of the embodiment of FIG. 8, showing use of the device in its exercise configuration by an amputee patient.
Figure 10:
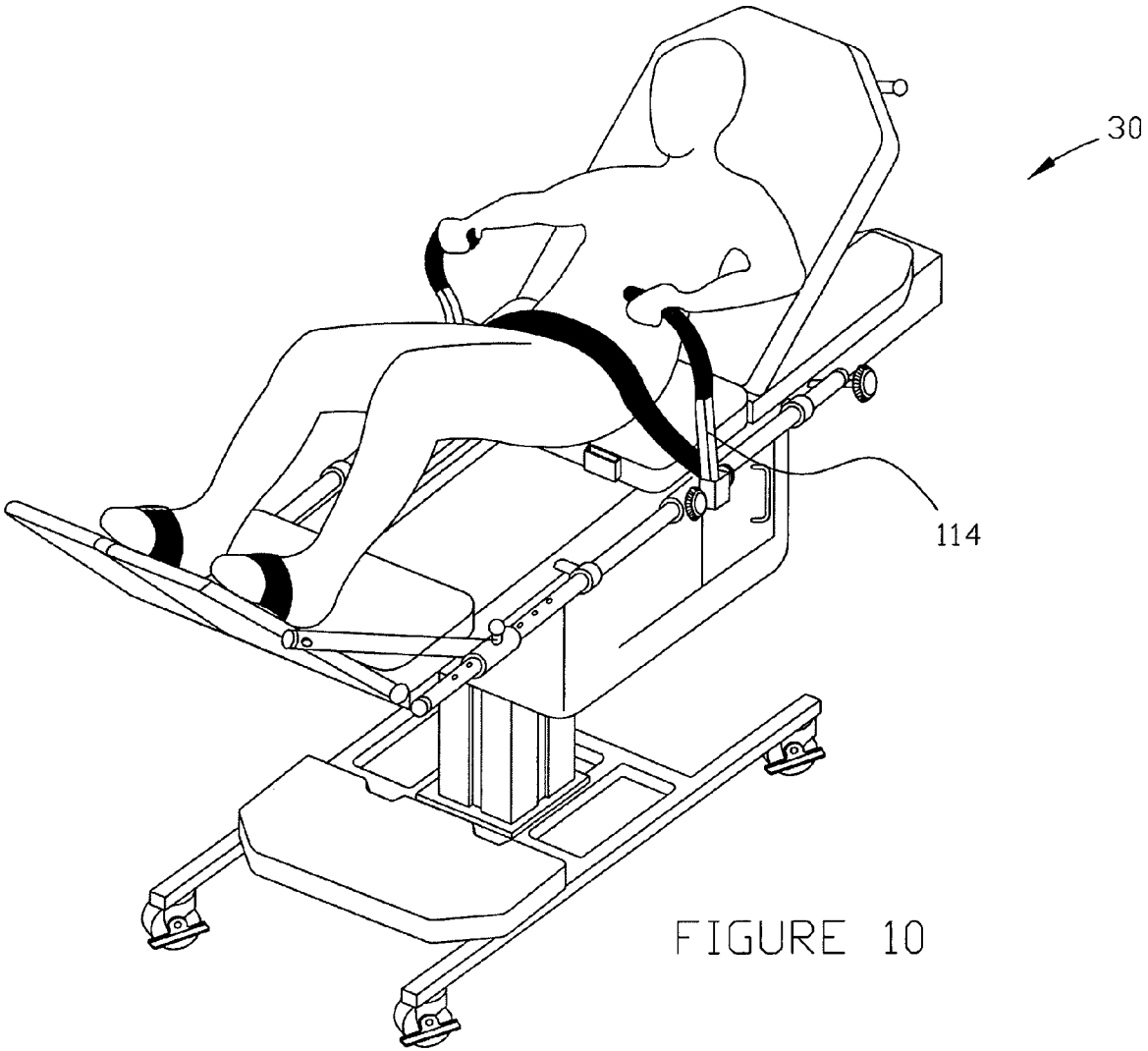
FIG. 10 is a perspective view of a preferred embodiment of the therapeutic exercise device, showing use of the device in its exercise configuration by a patient.

As shown in FIG. 15, fixation brackets 112 are preferably located on the adjustment rails 63 to accept removable hand grips 114 (see FIGS. 9 and 10). The grips may be removably inserted into the fixation brackets and tightened with grip locking knobs 116. The hand grips can be adjusted to the patient's height by sliding the fixation brackets to the desired position along the adjustment rail and tightened to the rail with bracket locking knobs 118. An important feature of the hand grips is the curved design that permits the patient to move his elbows laterally during exercise.

Figure 16:
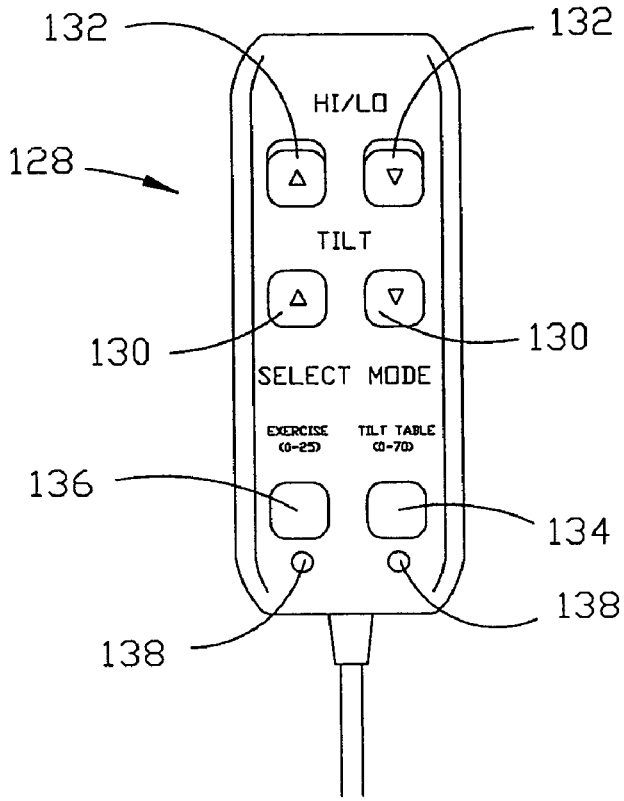
FIG. 16 is a front view of a controller for a preferred embodiment of the therapeutic exercise device.
Figure 17:
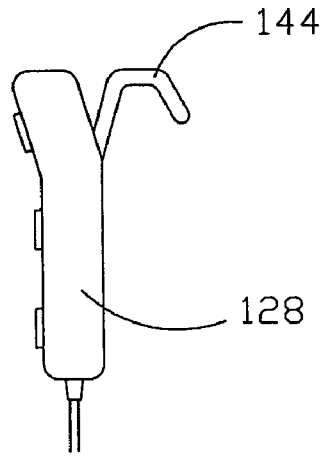
FIG. 17 is a side view of the controller of FIG. 16.
Figure 18:
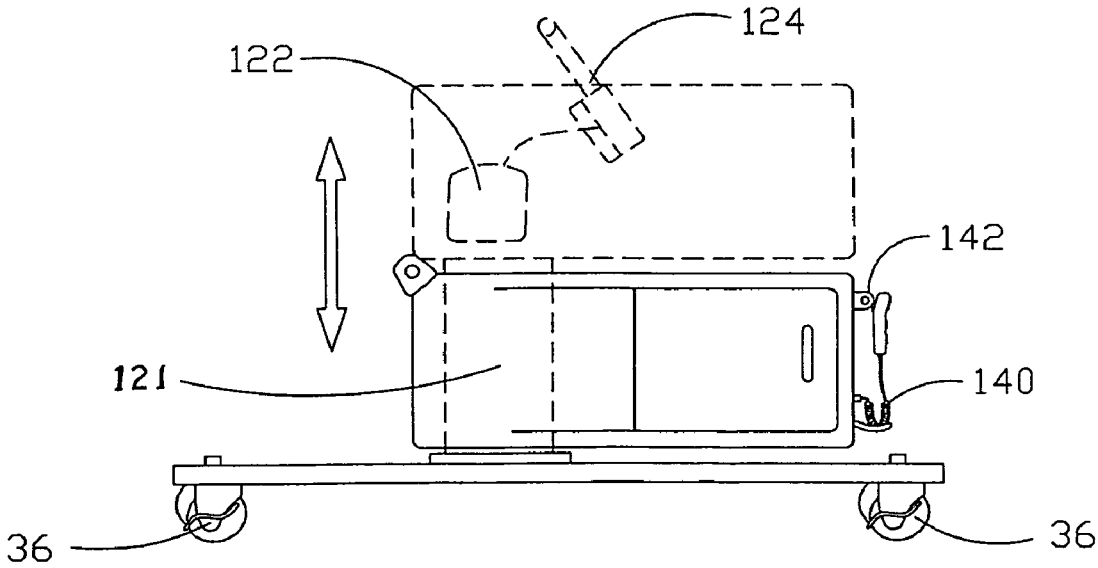
FIG. 18 is side view of a portion of the base of a preferred embodiment of the therapeutic exercise device.

Wheels 36 of base 32 allow the device to be transported to a patient's hospital room. Preferably, wheels 36 are provided with conventional locking devices such as wheel locks 120 (shown in FIG. 2) so that the device may be locked against rolling movement next to a patient's bed. Preferably, column 38 includes an electric lift mechanism 121 (see FIG. 18) powered by motor 122 and controlled by controller 124 for raising and lowering the support frame with respect to the base. It is desirable that the support frame be adapted to be elevated to different heights, such as (for example) heights between 19 and 34 inches off the floor in order to make the device accessible from a wheelchair or to accommodate transfers from different bed heights. Electric lift mechanism may also be employed to tilt support frame 42 between a generally horizontal attitude that may be as much as 80° from the horizontal (see FIG. 11). An electrical cord 126 (see FIG. 2) and a handheld control 128 (see FIGS. 16 and 17) may be connected to the electrical motor 122 in column 38. The controller may include switches or buttons 130 to incline/decline the support frame and buttons 132 to elevate/lower the frame on column 38. A safety mechanism may also be included in controller 128 so that either tilt button 134 or exercise mode button 136 must be engaged for operation. Indicator lights 138 may be illuminated to indicate which mode the device is set for. When the tilt table mode is activated, the preferred tilting mechanism will allow inclination of up to 80° of inclination. If the device is set in the exercise mode, the safety mechanism will preferably limit the lift mechanism so that the angle at which the support frame is pivoted may not exceed about 25°. This safety mechanism ensures a therapist from over-tilting the device during exercise as this could cause injury to the patient.

A cord holder 140, as well as a control holder 142 (on which hanger 144 of controller may be placed), are located on the base for storage. It is also within the scope of this invention for the electrical system to be replaced with a rechargeable battery system. Such an improvement would eliminate the need to find an electrical outlet in the hospital room.

As shown in FIGS. 7-9 and 13, one or two upper leg supports 146 may be removably mounted on the carriage to allow a patient with a weight-bearing restriction to safely exercise using the device. Examples of patients with such restrictions include those with an amputation or a leg fracture. A frame 148 of upper leg support 146 may be inserted into one of the two eyelets 149 located on the inferior border of the carriage 44 and has an eyelet stop 150 that keeps the frame from sliding through the eyelet. A strap 152 on the upper leg support may be employed to secure the leg onto the support.

As has been described herein, device 30 employs a single lift and tilt mechanism 121 that is adapted to pivot the support frame on the base, and to pivot the upper section of the carriage with respect to the lower section.

Figure 23:
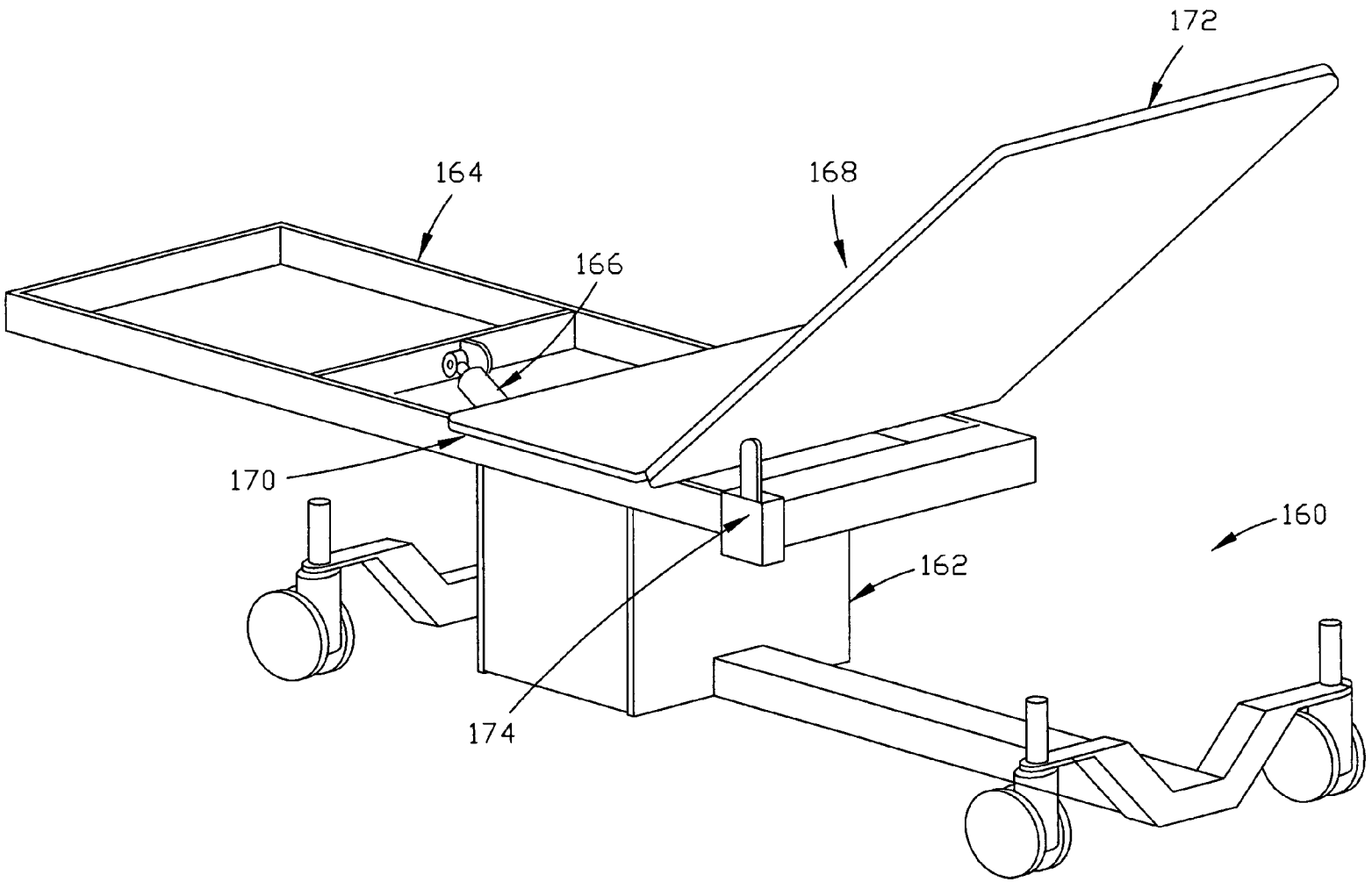
FIG. 23 is a perspective view of an alternative embodiment of the base and carriage of the therapeutic exercise device.

FIG. 23 illustrates an embodiment of the invention in which separate tilt mechanisms are employed to pivot the support frame on the base and to pivot the upper section of the carriage with respect to the lower section. As shown therein, base 160 includes a support column 162 on which is mounted support frame 164. A first tilt mechanism or actuator 166 may be employed to pivot the support frame on the base. Preferably, actuator 166 is adapted to tilt the support frame on the base from a generally horizontal attitude to an attitude that is about 80° from the horizontal.

Carriage 168 of the embodiment of FIG. 23 is mounted for sliding movement along at least a portion of the support frame, and includes lower section 170 and upper section 172 that is pivotally attached to the lower section. A second tilt mechanism or actuator 174 is adapted to pivot the upper section of the carriage with respect to the lower section. A third tilt mechanism similar to actuator 174 (not shown) may also be mounted on the side of the frame opposite actuator 174 and adapted to work in tandem with actuator 174. Preferably, actuator 174 (and if desired, a third actuator) is adapted to pivot the upper section of the carriage with respect to the lower section within a range of 0-45°.

Preferred embodiment 30 of the invention may be used for exercise by first placing switch 136 in the "exercise" mode. In this mode, center section 68 should be removed from the support frame and carriage 44 should be locked to the support frame. Wheels 36 on the base allow a therapist to move the device next to a patient's bed and the lift mechanism allows the therapist to match the height of the device with the patient's bed. Preferably, the wheels can then be locked in place and the patient transferred onto the device while in a supine position using a sheet. The patient may be secured to the locked carriage with a safety strap across his waist. The upper section of the carriage may be raised to enhance respiration and the patient's feet secured to the foot rests. After the patient is secured, the carriage may be unlocked from the support frame and the support frame gradually tilted to an incline at which the patient is able to perform a shallow, controlled squat by flexing his knees and extending back up to a "standing" position (see FIG. 10).

A range-of-motion (ROM) stop limits the amount of carriage travel or squat depth. When positioned at a higher position on the support frame, the carriage is limited to travel a short distance allowing the patient to perform a shallow squat exercise. Positioning the ROM stop lower on the support frame allows greater knee flexion for a more intense exercise. The ROM stop serves as a safety mechanism by preventing the patient from sliding down the device if his knees were to buckle. When the patient requires a rest break, the therapist locks the carriage back in place and lowers the incline of the support frame. The ROM stop may also function as a feedback system by producing an auditory chime when the carriage wheels contact a sensor on the stop. This indicates that the patient has performed a successful repetition.

The amount of force the patient must exert to fully extend his legs from the squat position is dependent on the incline of the support frame. For example, a 20-degree tilt corresponds to approximately 40% of the patient's weight and a 30-degree tilt corresponds to approximately 70% of the patient's body weight. This ability to change resistance levels allows therapists to adjust the exercise intensity to a patient's tolerance while the patient remains on the exercise device. This type of weight-bearing exercise is ideal during the acute stage of recovery because it simulates the sit-to-stand activity while bearing only a portion of the patient's body weight in a controlled and secure environment. The tilt of the support frame can be gradually increased daily until the patient's leg strength is strong enough to perform the exercise with a substantial percentage of his body weight such as 60% of his weight (corresponding to a 25° incline). When the device is in the "exercise" mode, the tilting mechanism will preferably only allow inclination of up to 25°. Standing from a chair or bed can then be initiated safely with less assistance from the therapist, as the patient has progressively strengthened the muscles responsible for performing the task of standing.

The preferred device may also be used for upper extremity exercise. Adjustable hand grips are located on either sides of the carriage to allow a patient to participate in upper extremity exercise while exercising his legs. These grips are also used to allow a patient to increase his knee flexion by pulling with his arms and gradually stretching the knee joint during the squat exercise. The bars can be adjusted by sliding up or down to accommodate the patient's height. Another important feature of the grips is that they can be removed. This allows therapists to transfer the patient laterally onto the device from a bed without coming into contact with the grips. Finally, the grips are curved to facilitate normal upper extremity movement by allowing the elbow to move laterally during exercise. The disadvantage of conventional or straight grip bars is that they force the elbows to move downwards and contact the carriage. The curved grips allow the elbows to move laterally in a normal fashion without engaging the carriage.

Still another use for the device is to allow a patient to participate in unilateral leg strengthening exercise. The device can be used for patients with a weight-bearing restriction on one leg. An upper leg support may be installed on either side of the carriage's lower edge, supporting the involved lower extremity. The foot rests are individually pivotally mounted on the frame so that by releasing the foot rest on the involved side, a patient is able to perform the lower extremity squatting exercise exclusively with the uninvolved leg without the affected leg coming in contact with a foot rest. The device may be used daily until the patient is ready to progress to standing from the bed with assistive device such as a walker (see FIG. 9). The device may also be used in neurological rehabilitation when a patient has hemiparesis, or one-sided weakness, caused by a stroke or a closed head injury. In this application, the upper leg support may be installed to support the unaffected leg, allowing the patient to focus on strengthening and motor control of the affected leg at a portion of the patient's own body weight.

Figure 13:
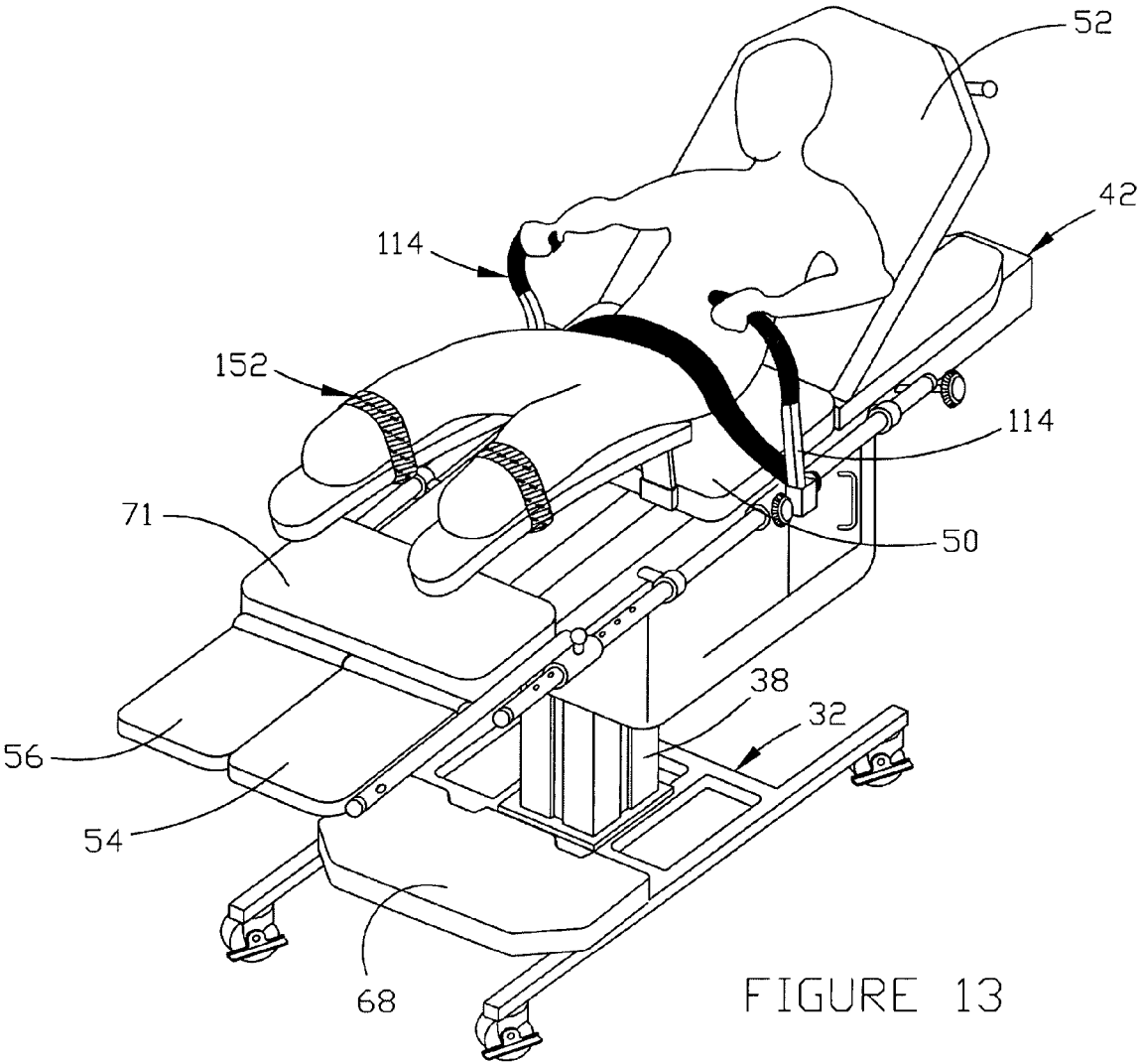
FIG. 13 is a perspective view of the embodiment of FIG. 8, showing use of the device in its exercise configuration by a double-amputee patient.

The device may also be used by patients with bilateral leg involvement to participate in exclusive upper extremity workouts. Two upper leg supports are installed as shown in FIG. 13. In this application, both foot rests are released to allow the patient to slide down and push back up for shoulder depressor strengthening. This would be useful for patients that are unable to use their legs such as those with bilateral lower extremity fractures, bilateral amputations, or patients with lower extremity paralysis. These patients will progress to scooting transfers into a wheelchair using their upper extremity strength.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A therapeutic exercise device comprising:

(a) a base;

(b) a support frame that is pivotally mounted on the base, said support frame having a lower end and an upper end;

(c) a carriage that is mounted for sliding movement along at least a portion of the support frame, said carriage comprising:

(i) a lower section that is adapted to support at least a portion of the hips and legs of a patient;

(ii) an upper section that is pivotally attached to the lower section, said upper section being adapted to support the back of the patient; and (iii) a tilt mechanism that is adapted to pivot the upper section of the carriage with respect to the lower section;

(d) a left foot rest and a right foot rest, each of which is independently pivotally attached to the lower end of the support frame;

(e) a body-restraining belt that is adapted to secure the body of a patient to the carriage;

(f) an ankle support pad which is attached to the lower end of the support frame;

(g) a center section which is adapted to be removably attached to the support frame between the ankle section and the lower section of the carriage;

wherein said ankle support pad and said center section are sized and arranged so that attachment of the center section on the support frame between the ankle section and the lower section of the carriage will prevent the carriage from moving along the support frame.

2. The therapeutic exercise device of claim 1 which includes a pair of hand grips which are adapted to be removably attached to the support frame.

3. The therapeutic exercise device of claim 1 which includes a pair of body-restraining belts that are adapted to secure the body of a patient to the device, wherein one of said belts is located and arranged to secure the midsection of the patient to the carriage and the other of said belts is located and arranged to secure the legs of the patient to the device.

4. The therapeutic exercise device of claim 1 which includes a lift mechanism for raising and lowering the support frame with respect to the base.

5. The therapeutic exercise device of claim 1 which includes a restraining belt for the left foot rest and a restraining belt for the right foot rest.

6. The therapeutic exercise device of claim 1 wherein each of the foot rests may be independently pivoted between an angle of 0° with respect to the support frame and an angle of about 90° with respect to the support frame.

7. The therapeutic exercise device of claim 1 which includes a range of motion stop that is adjustably mounted on the support frame and adapted to limit the sliding motion of the carriage at a plurality of locations on the support frame.

8. The therapeutic exercise device of claim 1 which includes an upper leg support that is removably mounted on the carriage.

9. A therapeutic exercise device comprising:

(a) a base;

(b) a support frame that is pivotally mounted on the base, said support frame having a lower end and an upper end;

(c) a carriage that is mounted for sliding movement along at least a portion of the support frame, said carriage comprising:

(i) a lower section;

(ii) an upper section that is pivotally attached to the lower section;

(d) a left foot rest and a right foot rest, each of which is independently pivotally attached to the lower end of the support frame;

(e) a body-restraining belt that is adapted to secure the body of a patient to the carnage;

(f) a range of motion limit detector which is adapted for determining when the carriage is moved to a predetermined position on the lower end of the support frame.

10. The therapeutic exercise device of claim 9 which includes a signaling mechanism for signaling each time that the carriage is moved to the predetermined position on the lower end of the support frame.

11. The therapeutic exercise device of claim 1 which includes a mechanism for removably fixing the carriage on the support frame so as to prevent sliding movement of the carriage thereon.

12. The therapeutic exercise device of claim 11 which includes a tilt mechanism that is adapted:

(a) to pivot the support frame on the base; and (b) to pivot the upper section of the carriage with respect to the lower section.

13. The therapeutic exercise device of claim 11 which includes a first tilt mechanism that is adapted to pivot the support frame on the base, and a second tilt mechanism that is adapted to pivot the upper section of the carriage with respect to the lower section.

14. The therapeutic exercise device of claim 13 wherein the first tilt mechanism is adapted to tilt the support frame on the base from a generally horizontal attitude to an attitude that is about 80° from the horizontal.

15. The therapeutic exercise device of claim 13 wherein the second tilt mechanism is adapted to pivot the upper section of the carriage with respect to the lower section within a range of 0°-45°.

16. A therapeutic exercise device which comprises:

(a) a base;

(b) a support frame that is pivotally mounted on the base, said support frame having a lower end and an upper end;

(c) a carriage that is mounted for sliding movement along at least a portion of the support frame, said carriage comprising:

(i) a lower section;

(ii) an upper section that is pivotally attached to the lower section;

(d) a left foot rest and a right foot rest, each of which is independently pivotally attached to the lower end of the support frame;

(e) a body-restraining belt that is adapted to secure the body of a patient to the carnage;

(f) a left-foot force measuring mechanism that is adapted to measure the force that is applied to the left foot rest; and (g) a right-foot force measuring mechanism that is adapted to measure the force that is applied to the right foot rest.

17. The therapeutic exercise device of claim 16 which includes a left digital readout for displaying the forces that are applied to the left foot rest and a right digital readout for displaying the forces that are applied to the right foot rest.

18. The therapeutic exercise device of claim 1 which includes a timer for measuring the time that the carriage is held in a predetermined position.

19. The therapeutic exercise device of claim 18 which includes a signaling device for generating a signal at a predetermined rate during the time that the carriage is held in the predetermined position.

* * * * *